US007633240B2

(12) United States Patent
Kwon

(10) Patent No.: US 7,633,240 B2
(45) Date of Patent: Dec. 15, 2009

(54) LAMP DRIVING APPARATUS HAVING BALANCE CIRCUIT UNITS FOR A DISPLAY

(75) Inventor: Young Sup Kwon, Seoul (KR)

(73) Assignee: Samsung Electronics Co., Ltd., Gyeonggi-do (KR)

( * ) Notice: Subject to any disclaimer, the term of this patent is extended or adjusted under 35 U.S.C. 154(b) by 95 days.

(21) Appl. No.: 11/703,897

(22) Filed: Feb. 7, 2007

(65) Prior Publication Data

US 2007/0182343 A1 Aug. 9, 2007

(30) Foreign Application Priority Data

Feb. 7, 2006 (KR) ..... 10-2006-0011809

(51) Int. Cl.
*H05B 41/16* (2006.01)

(52) U.S. Cl. ..... 315/282; 315/274; 315/279; 315/312; 315/324

(58) Field of Classification Search ..... 315/274–289, 315/312–326
See application file for complete search history.

(56) References Cited

U.S. PATENT DOCUMENTS 5,767,630 A * 6/1998 Williams ..... 315/282
5,936,359 A * 8/1999 Gibson ..... 315/276
7,271,546 B2 * 9/2007 Nakano ..... 315/246
7,291,987 B2 * 11/2007 Chang et al. ..... 315/282
7,309,964 B2 * 12/2007 Wey et al. ..... 315/312
7,345,431 B2 * 3/2008 Lee ..... 315/224
7,446,750 B2 * 11/2008 Moon ..... 345/102
7,449,848 B2 * 11/2008 Nishinosono ..... 315/312
2005/0017658 A1 * 1/2005 Chien et al. ..... 315/276
2005/0093484 A1 * 5/2005 Ball ..... 315/291
2005/0140312 A1 * 6/2005 Nishinosono et al. ..... 315/224
2006/0091821 A1 * 5/2006 Li et al. ..... 315/209 R
2006/0273745 A1 * 12/2006 Wey et al. ..... 315/312
2007/0046218 A1 * 3/2007 Ger et al. ..... 315/308
2007/0085493 A1 * 4/2007 Kuo et al. ..... 315/282
2007/0152608 A1 * 7/2007 Lee ..... 315/282
2007/0247082 A1 * 10/2007 Ashikaga et al. ..... 315/277

* cited by examiner

*Primary Examiner*—Tuyet Vo
(74) *Attorney, Agent, or Firm*—Innovation Counsel LLP

(57) ABSTRACT

A lamp driving apparatus wherein a plurality of two-winding balance circuits are connected to a plurality of parallel-connected lamp groups so that all of the lamps may be illuminated even though ambient conditions cause some of the lamps to have low resistance. Capacitors are connected to first electrodes and certain of the balance coil windings are connected to second electrodes of one of the lamp groups while, in a second lamp group, others of the balance coil windings are connected to the first electrodes and capacitors are connected to the second electrodes thereof, current flowing through balance coil windings to some lamps being affected by current flowing through balance coil windings to other lamps.

16 Claims, 4 Drawing Sheets

LAMP DRIVING APPARATUS HAVING BALANCE CIRCUIT UNITS FOR A DISPLAY

CROSS REFERENCE TO RELATED APPLICATION

This application claims the benefit of priority of Korean Patent Application No. 10-2006-0011809 filed on Feb. 7, 2006.

FIELD OF THE INVENTION

The present invention relates to a lamp driving apparatus for a display and, more particularly, to a lamp driving apparatus capable of more stably driving a plurality of lamps in parallel.

DESCRIPTION OF THE RELATED ART

Back-lighted displays often employ one or more cold cathode fluorescent lamps as the light source. In recent years, large-sized LCDs with high luminance have required an increased number of lamps, increasing the size and cost of the driving apparatus. FIG. 1 is a schematic view showing a prior art lamp driving apparatus in which a DC/AC inverter 21, a transformer 23 and a controller 25 supply power to a parallel-connected plurality of lamps 10. Because the load characteristic of certain lamps is affected by temperature, current may flow only to lamps having low resistance resulting in only some of the lamps being illuminated. Accordingly, there is a need for a driving apparatus in which current is applied so that all lamps are illuminated.

SUMMARY OF THE INVENTION

The present invention provides a lamp driving apparatus wherein a plurality of two-winding balance circuits are connected to a plurality of parallel-connected lamp groups so that all of the lamps may be illuminated even though ambient conditions cause some of the lamps to have low resistance. Capacitors are connected to first electrodes and certain of the balance coil windings are connected to second electrodes of one of the lamp groups while, in a second lamp group, others of the balance coil windings are connected to the first electrodes and capacitors are connected to the second electrodes thereof, current flowing through balance coil windings to some lamps being affected by current flowing through balance coil windings to other lamps.

BRIEF DESCRIPTION OF THE DRAWINGS

The above and other objects, features and advantages of the present invention may become more apparent from a reading of the ensuing description together with the drawing, in which.

DETAILED DESCRIPTION OF THE INVENTION

Figure 1:
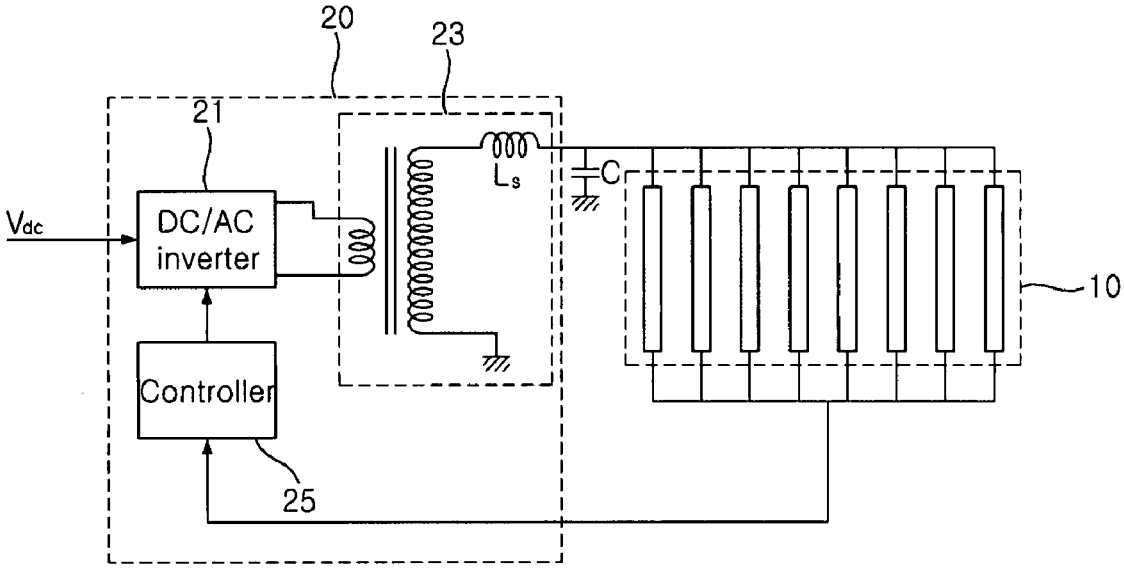
FIG.1 (PRIOR ART)
FIG. 1 is a schematic view showing a configuration of a conventional lamp driving apparatus of a liquid crystal display (LCD)
Figure 2:
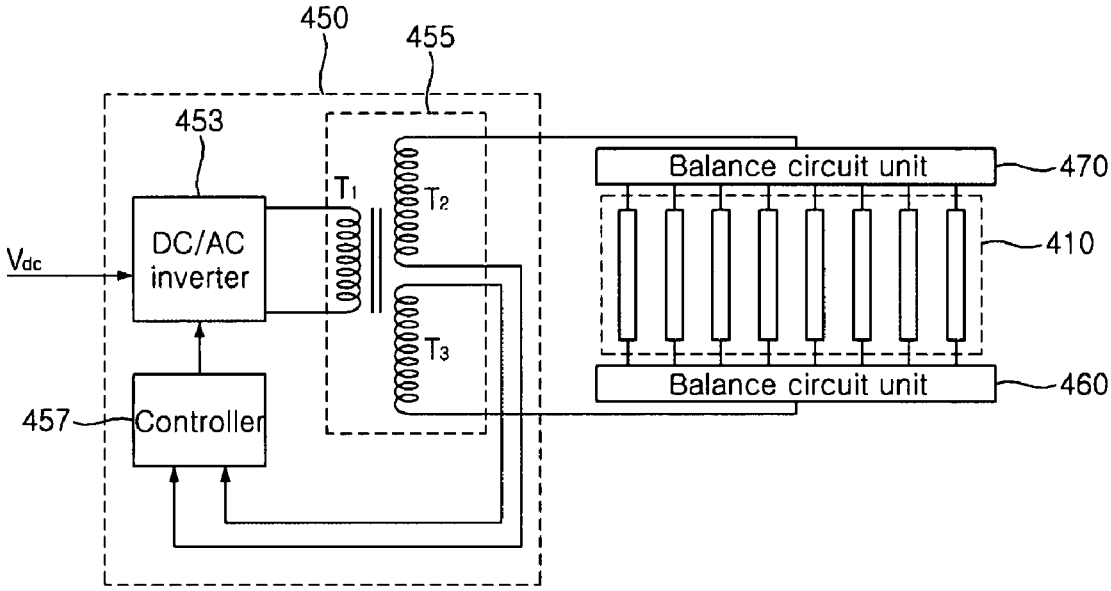
FIG. 2 is a schematic view showing a configuration of a lamp driving apparatus for a display according to the present invention.

FIG. 2 is a schematic view showing a configuration of a lamp driving apparatus for a back-lighted display such as a liquid crystal display (LCD). Referring to FIG. 2, the lamp driving apparatus comprises a plurality of lamps 410, an inverter unit 450 for applying a driving voltage to the plurality of lamps 410, and balance circuit units 460 and 470 for supplying a uniform current to the plurality of lamps 410.

Each of the plurality of lamps 410 comprises a lamp tube and electrodes formed at both ends of the lamp tube. Further, the lamp tube comprises a body, a fluorescent substance layer, and a discharge gas. If a voltage is applied to the electrodes of the lamp, invisible light generated when the discharge gas is changed into plasma in the lamp tube excites the fluorescent substance layer so that visible light can be emitted to the outside, each of the lamps 410 may be a cold cathode fluorescent lamp (CCFL), a hot cathode fluorescent lamp (HCFL), an external electrode fluorescent lamp (EEFL) or an external and internal electrode fluorescent lamp (EIFL).

The inverter unit 450 comprises a DC/AC inverter 453 for converting a DC voltage supplied from the outside into an AC voltage, a transformer 455 for converting the level of the AC voltage output from the DC/AC inverter 453, and a controller 457 for controlling the operation of the DC/AC inverter.

The transformer 455 comprises a first winding $T_1$ connected to output terminals of the DC/AC inverter 453, a second winding $T_2$ for providing a first phase voltage, and a third winding $T_3$ for providing a second voltage with a second phase, the first and second voltages having phases opposite to each other.

The plurality of lamps 410 are connected in parallel with the transformer 455 of the inverter unit 450. First and second electrodes are formed at both ends of each of the plurality of lamps 410 and the balance circuit units 460 and 470 are connected to the electrodes, respectively. Further, one ends of the second and third windings $T_2$ and $T_3$ of the transformer 455 are connected to the balance circuit units 460 and 470, respectively, and the other ends are connected to the controller 457.

The balance circuit units 460 and 470 are connected to the electrodes formed respectively at the both ends of each of the plurality of lamps 410 so that they can perform the function of controlling load characteristics of the lamps not to vary according to temperature and an ambient environment, thereby adjusting a current balance such that a uniform current flows to the plurality of lamps 410. A first voltage output of winding $T_2$ of transformer 455 is applied to one electrodes of the lamps via the balance circuit unit 470, and the second voltage output of winding $T_3$ of the transformer 455 is applied to the other electrodes of the lamps via the balance circuit unit 460, so that the plurality of lamps 410 can be stably driven using the single transformer 455.

Figure 3:
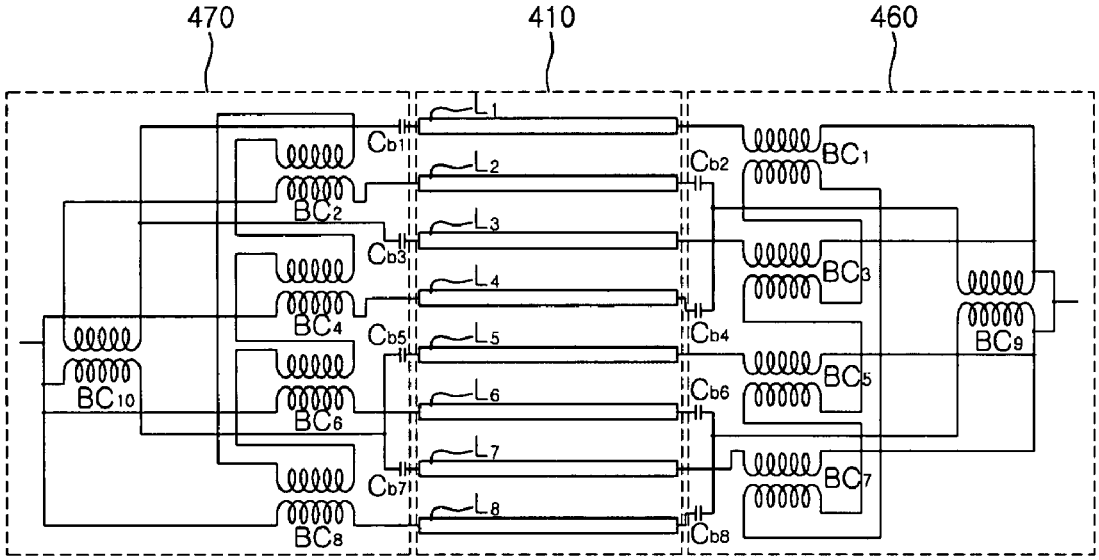
FIG. 3 is a schematic view showing configurations of balance circuit units of a lamp driving apparatus according to a first embodiment of the present invention.

FIG. 3 is a schematic view showing a configuration of balance circuit units of a lamp driving apparatus according to a first embodiment of the present invention.

Referring to FIG. 3, the balance units 460 and 470 of the lamp driving apparatus have a plurality of capacitors $C_{bn}$ and a plurality of coils $BC_n$. The plurality of lamps 410 comprise eight lamps $L_1$ to $L_8$. As described above, first and second electrodes are formed at both ends of each of the lamps. The capacitor $C_{bn}$ is connected to any one of the first and second electrodes of the lamp and the balance coil $BC_n$ is connected to the other electrode, thereby constructing the balance circuit units 460 and 470 simultaneously using capacitors and balance coils.

The plurality of lamps 410 are composed of a first lamp group $L_1$, $L_3$, $L_5$ and $L_7$, and a second lamp group $L_2$, $L_4$, $L_6$ and $L_8$. Further, capacitors $C_{b1}$, $C_{b3}$, $C_{b5}$ and $C_{b7}$ are connected in series to the first electrodes of the lamps belonging to the first lamp group $L_1$, $L_3$, $L_5$ and $L_7$, and balance coils $BC_1$, $BC_3$, $BC_5$ and $BC_7$ are connected to the second electrodes, any one of first and second coils of each of balance coils $BC_1$, $BC_3$, $BC_5$ and $BC_7$ is connected to the second electrode of the lamp, and the other coil of the first and second coils is connected to form a loop. Balance coils $BC_2$, $BC_4$, $BC_6$ and $BC_8$ are connected in series to the first electrodes of the lamps belonging to the second lamp group $L_2$, $L_4$, $L_6$ and $L_8$, and capacitors $C_{b2}$, $C_{b4}$, $C_{b6}$ and $C_{b8}$ are connected to the second electrodes, any one of the first and second coils of each of balance coils $BC_2$, $BC_4$, $BC_6$ and $BC_8$ is connected to the first electrode of the lamp, and the other coil of the first and second coils is connected to form a loop.

In the plurality of lamps 410, the lamps belonging to the first lamp group and those belonging to the second lamp group are alternately arranged one by one. Further, the balance circuit units 460 and 470 further include balance coils $BC_9$ and $BC_{10}$, respectively. Furthermore, the balance coil $BC_9$ connects capacitors $C_{b2}$, $C_{b4}$, $C_{b6}$ and $C_{b8}$ and balance coils $BC_1$, $BC_3$, $BC_5$ and $BC_7$, which are connected to the second electrodes of the plurality of lamps 410, to the output terminal of the third winding $T_3$ of the transformer 455, and the balance coil $BC_{10}$ connects capacitors $C_{b1}$, $C_{b3}$, $C_{b7}$ and $C_{b9}$ and balance coils $BC_2$, $BC_4$, $BC_6$ and $BC_8$, which are connected to the first electrodes of the plurality of lamps 410, to the output terminal of the second winding $T_2$ of the transformer 455. Thus, a single transformer, eight capacitors and ten balance coils are required to drive eight lamps.

As described above, since the balance circuit units are constructed by compositely using ballast capacitors with a relatively low price and balance coils with superior reliability, the cost of the lamp driving apparatus can be reduced and the reliability thereof can be improved. Although this embodiment has been described in connection with the configuration in which the eight lamps can be simultaneously driven in parallel using the single transformer, this is only for convenience of illustration. The number of lamps and the numbers of capacitors and balance coils depending thereon are not limited thereto.

Figure 4:
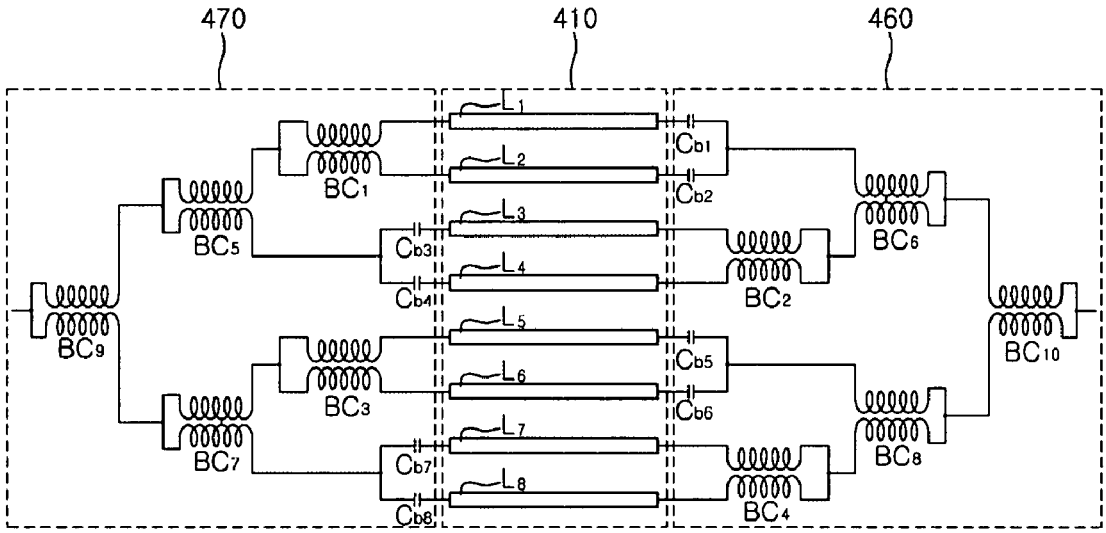
FIG. 4 is a schematic view showing configurations of balance circuit units of a lamp driving apparatus according to a second embodiment of the present invention.

FIG. 4 is a schematic view showing a configuration of balance circuit units of a lamp driving apparatus according to a second embodiment of the present invention. In the balance circuit units of the lamp driving apparatus according to the second embodiment shown in FIG. 4, the arrangement of capacitors and balance coils is different from that in the first embodiment. A different configuration will be mainly described below.

The balance circuit units 460 and 470 of the lamp driving apparatus have a plurality of capacitors $C_{bn}$ and a plurality of coils $BC_n$. The plurality of lamps 410 comprise eight lamps $L_1$ to $L_8$. As described above, first and second electrodes are formed at both ends of each of the lamps. The capacitor $C_{bn}$ is connected to any one of the first and second electrodes of the lamp, and the balance coil $BC_n$ is connected to the other, thereby constructing the balance circuit units simultaneously using capacitors and balance coils.

The plurality of lamps 410 are composed of a first lamp group $L_1$, $L_2$, $L_5$ and $L_6$, and a second lamp group $L_3$, $L_4$, $L_7$ and $L_8$. Further, balance coils $BC_1$ and $BC_3$ are connected to the first electrodes of the lamps belonging to the first lamp group $L_1$, $L_2$, $L_5$ and $L_6$, and capacitors $C_{b1}$, $C_{b2}$, $C_{b5}$ and $C_{b6}$ are connected to the second electrodes. Capacitors $C_{b3}$, $C_{b4}$, $C_{b7}$ and $C_{b8}$ are connected in series to the first electrodes of the lamps belonging to the second lamp group $L_3$, $L_4$, $L_7$ and $L_8$, respectively, and balance coils $BC_2$ and $BC_4$ are connected to the second electrodes. That is, the lamps belonging to the first lamp group $L_1$, $L_2$, $L_5$ and $L_6$ and those belonging to the second lamp group $L_3$, $L_4$, $L_7$ and $L_8$ are alternately arranged one by one, and the two lamps belonging to the same lamp group are adjacent to each other. Further, the balance coil $BC_5$ is connected to the balance coil $BC_1$ and capacitors $C_{b3}$ and $C_{b4}$, and the balance coil $BC_7$ is connected to the balance coil $BC_3$ and capacitors $C_{b7}$ and $C_{b8}$. In addition, the balance coil $BC_9$ connects balance coils $BC_5$ and $BC_7$ to the output terminal of the second winding $T_2$ of the transformer 455. Similarly, the balance coil $BC_6$ is connected to the balance coil $BC_2$ and capacitors $C_{b1}$ and $C_{b2}$, and the balance coil $BC_8$ is connected to the balance coil $BC_4$ and capacitors $C_{b5}$ and $C_{b6}$. In addition, the balance coil $BC_{10}$ connects balance coils $BC_6$ and $BC_8$ to the output terminal of the third winding $T_3$ of the transformer 455. Thus, in the balance circuit units of the lamp driving apparatus according to the second embodiment of the present invention, a single transformer, eight capacitors and ten balance coils are also required to drive eight lamps in the same manner as the balance circuit units according to the first embodiment.

Figure 5:
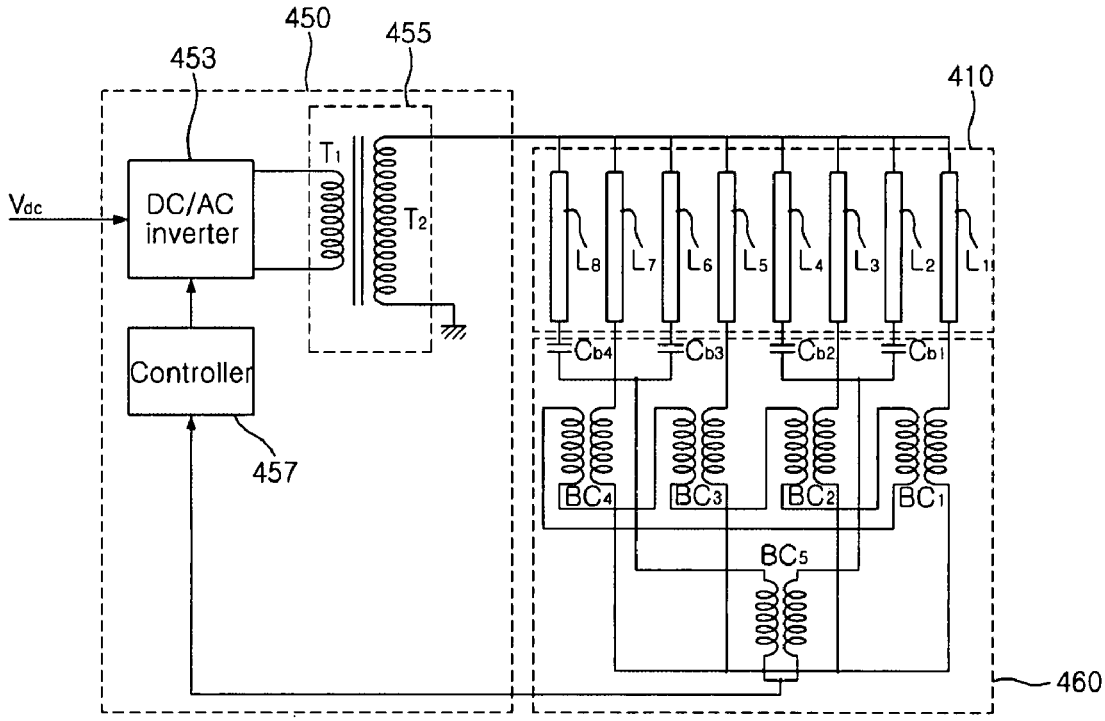
FIG. 5 is a schematic view showing a configuration of a lamp driving apparatus according to a third embodiment of the present invention.

FIG. 5 is a schematic view showing a configuration of a lamp driving apparatus according to a third embodiment of the present invention. Referring to FIG. 5, a balance circuit unit of the lamp driving apparatus according to the third embodiment shown in FIG. 5 is different from that of the first embodiment in that a voltage is applied only to any one of the first and second electrodes, and the balance circuit unit is also connected only to any one of the first and second electrodes. Since the configuration and arrangement of the balance circuit unit is identical with that of the first embodiment, a different configuration will be mainly described below.

The lamp driving apparatus comprises a plurality of lamps 410, an inverter unit 450 for applying a driving voltage to the plurality of lamps 410, and a balance circuit unit 460 for supplying a uniform current to the plurality of lamps 410.

The inverter unit 450 comprises a DC/AC inverter 453 for converting a DC voltage supplied from the outside into an AC voltage, a transformer 455 for converting the level of the AC voltage output from the DC/AC inverter 453, and a controller 457 for controlling the operation of the DC/AC inverter 453.

The transformer 455 includes a first winding $T_1$ connected to output terminals of the DC/AC inverter 453, and a second winding $T_2$ for inducing a voltage by means of a winding ratio thereof to the first winding $T_1$. The plurality of lamps 410 are connected in parallel with the transformer 455 of the inverter unit 450, and first and second electrodes are formed at both ends of each of the plurality of lamps 410. The balance circuit unit 460 is connected to any one of the first and second electrodes, and the second winding $T_2$ of the transformer 455 is connected to the other electrode to which the balance circuit unit 460 is not connected. The balance circuit unit 460 is connected to only any one of the first and second electrodes formed at the both ends of each of the plurality of lamps 410 so that it can perform the function of controlling load characteristics of the lamps not to vary according to temperature and an ambient environment, thereby adjusting a current balance such that a uniform current flows to the plurality of lamps 410. Accordingly, the plurality of lamps 410 can be more stably driven in parallel.

Figure 6:
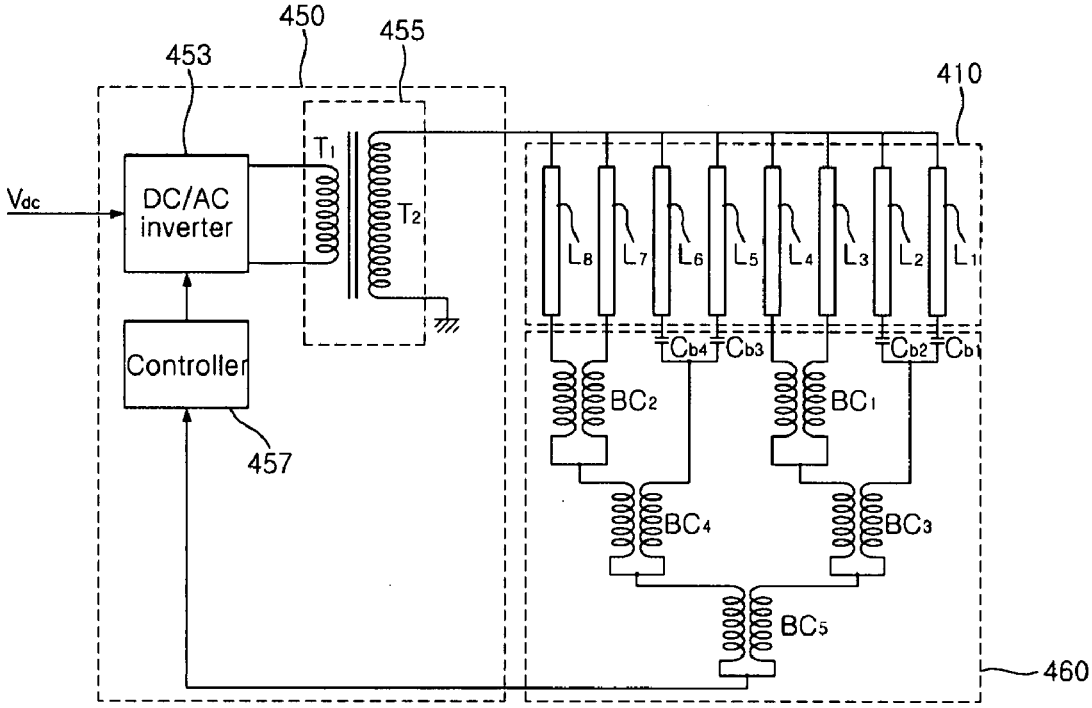
FIG. 6 is a schematic view showing a configuration of a lamp driving apparatus according to a fourth embodiment of the present invention.

FIG. 6 is a schematic view showing a configuration of a lamp driving apparatus according to a fourth embodiment of the present invention. A balance circuit unit of the lamp driving apparatus according to the fourth embodiment shown in FIG. 6 is different from the second embodiment in that a voltage is applied only to any one of the first and second electrodes formed at the both ends of each lamp and the balance circuit unit is also connected only to any one of the first and second electrodes. The configuration and arrangement of the balance circuit unit is almost identical with those in the first embodiment.

Figure 7:
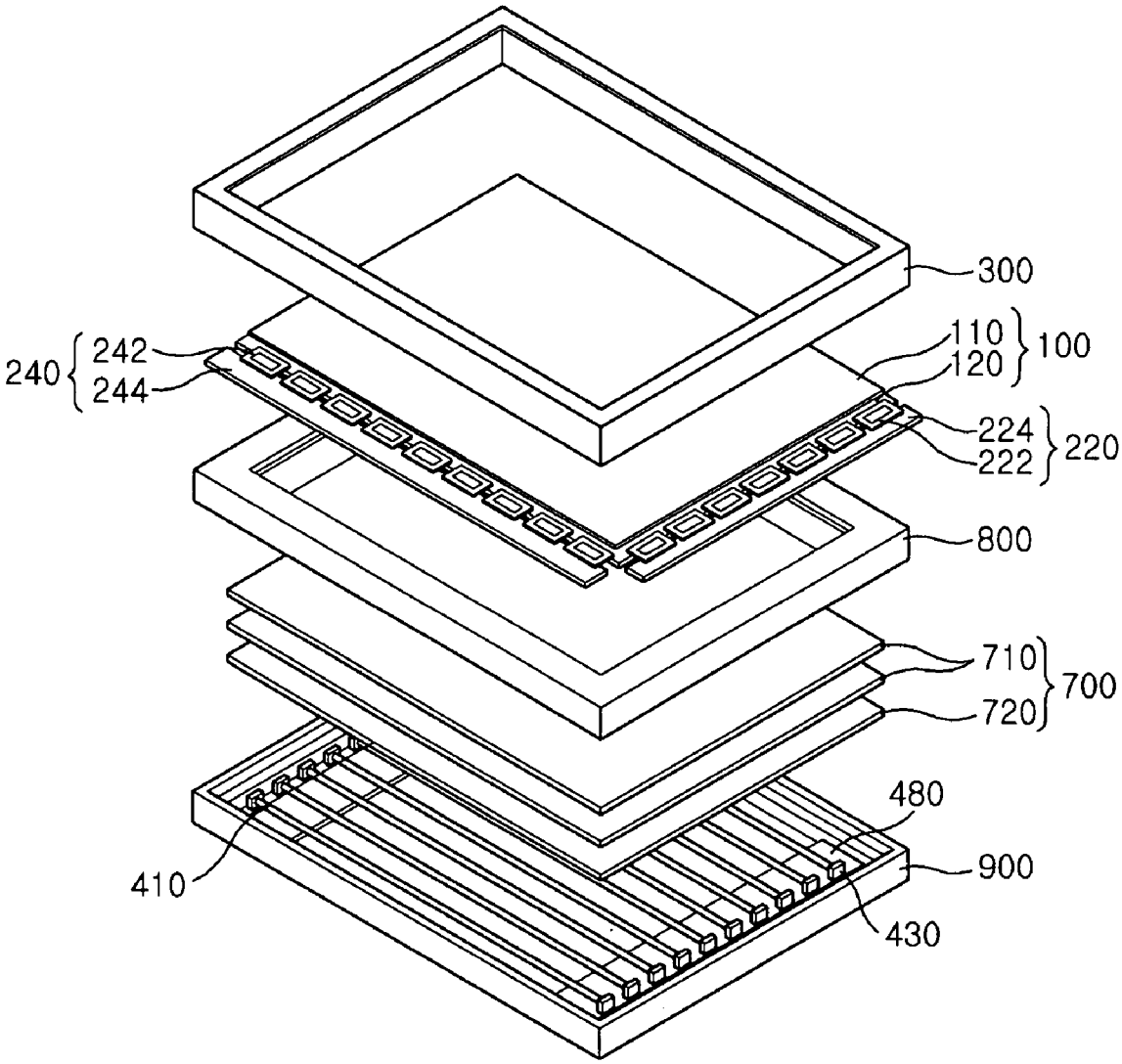
FIG. 7 is an exploded perspective view of a direct type LCD having a lamp driving apparatus according to the present invention.

FIG. 7 is an exploded perspective view of a direct type LCD having a lamp driving apparatus according to the present invention.

Referring to FIG. 7, the LCD comprises a top chassis 300, an LCD panel 100, driving circuit units 220 and 240, a mold frame 800, a plurality of optical sheets 710, a diffusion plate 720, a lamp unit, and a bottom chassis 900.

The driving circuit units 220 and 240 are connected to the LCD panel, and comprise a gate-side printed circuit board 224 having a control IC (Integrated Circuit) mounted thereon to apply a predetermined gate signal to gate lines of a TFT substrate 120, a data-side printed circuit board 244 having a control IC mounted thereon to apply a predetermined data signal to data lines of the TFT substrate 120, a gate-side flexible printed circuit board 222 having an exposed ground pattern to connect the gate-side printed circuit board 224 to the TFT substrate 120, and a data-side flexible printed circuit board 242 having an exposed ground pattern to connect the data-side printed circuit board 244 to the TFT substrate 120.

The gate- and data-side printed circuit boards 224 and 244 are connected to the gate- and data-side flexible printed circuit boards 222 and 242 to apply a gate driving signal and an external image signal. The gate- and data-side printed circuit boards 224 and 244 may be integrated into a single printed circuit board. Further, a driving IC (not shown) is mounted on the flexible printed circuit boards 222 and 242 so that it transmits RGB (Red, Green and Blue) signals generated from the printed circuit boards 224 and 244 and digital power to the LCD panel 100. Although a tape-automated bonding (TAB) mounting method has been described by way of example in the embodiment of the present invention, otherwise, it is also possible to employ a chip on glass (COG) mounting method in which a driving IC is not mounted on the flexible printed circuit boards 222 and 242 but is installed on a thin film transistor substrate.

The top chassis 300 is formed to take the shape of a rectangular frame with a plane portion and sidewall portions which are bent perpendicularly to one another so that the LCD panel 100 and the driving circuit units 220 and 240 cannot come out therefrom and can be simultaneously protected against an external impact.

The lamp unit comprises lamps 410, lamp sockets 430 in which the lamps 410 are seated, and a printed circuit board 480 on which the lamp sockets 430 and a lamp driving apparatus (not shown) are mounted. As described above, the lamp driving apparatus mounted on the printed circuit board 480 comprises an inverter unit for applying a driving voltage to the lamps 410, and a balance circuit unit for supplying a uniform current to the plurality of lamps 410. Further, the plurality of lamps 410 are connected in parallel with the inverter unit, and the balance circuit unit has a plurality of capacitors and a plurality of balance coils.

The plurality of optical sheets 710, the diffusion plate 720, at least one lamp unit and a reflection plate (not shown) are sequentially stacked from the bottom of a storage space defined at a lower portion of the mold frame 800, and the bottom chassis 900 is coupled to the mold frame 800 to support the aforementioned components thereon.

As described above, according to the present invention, there is provided a lamp driving apparatus, wherein a balance circuit unit comprising capacitors and balance coils is connected to one end or both ends of each of a plurality of lamps so that the plurality of lamps can be stably driven with a single transformer. As a result, the number of parts required for the lamp driving apparatus is reduced, thereby obtaining an advantage of cost reduction.

The foregoing is merely exemplary embodiments of a lamp driving apparatus and a liquid crystal display having the same according to the present invention, and the present invention is not limited thereto. It will be readily understood by those skilled in the art that various modifications and changes can be made thereto without departing from the technical spirit and scope of the present invention defined by the appended claims.

What is claimed is:

1. A lamp driving apparatus, comprising:

a plurality of two-electrode lamps arranged in groups;

a plurality of two-winding balance coils with each corresponding to one of the plurality of two-electrode lamps;

a plurality of capacitors, and a transformer having two secondary windings;

wherein first capacitors are connected to first electrodes of a first lamp group and first windings of first balance coils are connected to second electrodes of the first lamp group, and first windings of second balance coils are connected to first electrodes of a second lamp group and second capacitors are connected to second electrodes of the second lamp group so that current flowing through the two-winding balance coils to some lamps is affected by current flowing through balance coils to others of the lamps, wherein the first balance coils are connected to one of the secondary windings of the transformer, and the second balance coils are connected to the other of the secondary windings of the transformer.

2. A lamp driving apparatus according to claim 1, wherein second windings of the first balance coils are connected in a series loop, and second windings of the second balance coils are connected in series loop.

3. A lamp driving apparatus according to claim 1, wherein current flowing through balance coils for the first lamp group is affected by current flowing through balance coils for the second lamp group.

4. A lamp driving apparatus according to claim 1, further including an DC/AC inverter unit; and a transformer connected between said DC/AC inverter unit and said plurality of balance coils and capacitors.

5. A lamp driving apparatus, comprising:

a plurality of two-electrode lamps arranged in groups;

an inverter unit for applying a driving voltage to the plurality of lamps;

a transformer having two secondary windings; and a balance circuit unit connected between an output terminal of the transformer and input terminals of the plurality of lamps for uniformly supplying a current to the plurality of lamps, wherein the plurality of lamps are connected in parallel with the inverter unit, the balance circuit unit has a plurality of capacitors and a plurality of two-winding balance coils with each two-winding balance coil corresponding to one of the plurality of two-electrode lamps, and a first voltage output from one of the secondary windings is applied to the first electrode of each of the lamps, and a second voltage from the other of the secondary windings of which the phase is opposite to that of the first voltage output is applied to the second electrode of each of the lamps;

wherein each of the plurality of lamps comprises:

a lamp tube;

first and second electrodes formed at both ends of the lamp tube;

a first lamp group including lamps with capacitors connected to the first electrodes thereof and with the corresponding two-winding balance coils connected to the second electrodes thereof; and a second lamp group including lamps with the corresponding two-winding balance coils connected to the first electrodes thereof and with capacitors connected to the second electrodes thereof.

6. The apparatus as claimed in claim 5, wherein the inverter unit comprises:

a DC/AC inverter for converting a DC voltage supplied from the outside into an AC voltage;

the transformer for converting the level of the AC voltage output from the DC/AC inverter; and a controller for controlling the operation of the DC/AC inverter.

7. The apparatus as claimed in claim 5, wherein the capacitor includes a ballast capacitor.

8. The apparatus as claimed in claim 5, wherein the transformer comprises:

a first winding connected to the DC/AC inverter;

a second winding for inducing the first voltage; and a third winding for inducing the second voltage.

9. The apparatus as claimed in claim 5, wherein the lamps of the first lamp group and those of the second lamp group are alternately arranged.

10. The apparatus as claimed in claim 9, wherein at least two lamps of the same lamp group are arranged to be adjacent to each other.

11. The apparatus as claimed in claim 5, wherein a voltage output from the transformer is applied to any one of the first and second electrodes of each of the lamps.

12. The apparatus as claimed in claim 11, wherein a capacitor or balance coil is connected to the other electrode of each of the lamps.

13. The apparatus as claimed in claim 12, wherein the plurality of lamps comprise:

a first lamp group including lamps with capacitors connected to the other electrodes thereof; and a second lamp group including lamps with the corresponding two-winding balance coils connected to the other electrodes thereof.

14. The apparatus as claimed in claim 13, wherein the lamps of the first lamp group and those of the second lamp group are alternately arranged.

15. The apparatus as claimed in claim 14, wherein at least two lamps of the same lamp group are arranged to be adjacent to each other.

16. A liquid crystal display (LCD), comprising:

a backlight unit having a lamp driving apparatus including:

a plurality of two-electrode lamps, an inverter unit for applying a driving voltage to the plurality of lamps, a transformer having two secondary windings; and a balance circuit unit connected between an output terminal of the transformer and input terminals of the plurality of lamps for uniformly supplying a current to the plurality of lamps, the plurality of lamps being connected in parallel with the inverter unit, the balance circuit unit having a plurality of capacitors and a plurality of two-winding balance coils with each two-winding balance coil corresponding to one of the plurality of two-electrode lamps; and an LCD panel positioned on the backlight unit to display an image thereon, wherein a first voltage output from one of the secondary windings is applied to the first electrode of each of the lamps, and a second voltage from the other of the secondary windings of which the phase is opposite to that of the first voltage output is applied to the second electrode of each of the lamps, wherein each of the plurality of lamps comprises:

a lamp tube;

first and second electrodes formed at both ends of the lamp tube;

a first lamp group including lamps with capacitors connected to the first electrodes thereof and with the corresponding two-winding balance coils connected to the second electrodes thereof; and a second lamp group including lamps with the corresponding two-winding balance coils connected to the first electrodes thereof and with capacitors connected to the second electrodes thereof.

* * * * *